US011133586B2

(12) United States Patent
Shen et al.

(10) Patent No.: US 11,133,586 B2
(45) Date of Patent: Sep. 28, 2021

(54) ANTENNA ARRAY WITH ABFN CIRCUITRY

(71) Applicant: Communication Components Antenna Inc., Kanata (CA)

(72) Inventors: Lin-Ping Shen, Ottawa (CA); Hua Wang, Ottawa (CA); Nasrin Hojjat, Kanata (CA); Willi Lotz, Carp (CA)

(73) Assignee: Communication Components Antenna Inc., Kanata (CA)

( * ) Notice: Subject to any disclaimer, the term of this patent is extended or adjusted under 35 U.S.C. 154(b) by 0 days.

(21) Appl. No.: 16/113,253

(22) Filed: Aug. 27, 2018

(65) Prior Publication Data

US 2019/0131707 A1 May 2, 2019

Related U.S. Application Data

(60) Provisional application No. 62/579,680, filed on Oct. 31, 2017.

(51) Int. Cl.

| | |
|---|---|
| ***H01Q 21/08*** | (2006.01) |
| ***H01Q 3/40*** | (2006.01) |
| ***H01Q 21/06*** | (2006.01) |
| ***H01P 5/18*** | (2006.01) |
| ***H01Q 1/24*** | (2006.01) |
| *H01Q 25/00* | (2006.01) |

(52) U.S. Cl.

CPC ..... *H01Q 3/40* (2013.01); *H01P 5/185* (2013.01); *H01Q 1/246* (2013.01); *H01Q 21/061* (2013.01); *H01Q 21/062* (2013.01); *H01Q 21/08* (2013.01); *H01Q 25/001* (2013.01)

(58) Field of Classification Search

CPC ..... H01Q 3/26–3/42; H01Q 21/06–21/08

See application file for complete search history.

(56) References Cited

U.S. PATENT DOCUMENTS

| | | | | |
|---|---|---|---|---|
| 5,603,089 | A * | 2/1997 | Searle | H01Q 3/242 455/507 |
| 5,629,713 | A * | 5/1997 | Mailandt | H01Q 1/246 343/792.5 |
| 5,966,102 | A * | 10/1999 | Runyon | H01Q 1/246 343/797 |
| 7,038,621 | B2 * | 5/2006 | Gabriel | H01Q 3/32 342/372 |
| 7,053,853 | B2 * | 5/2006 | Merenda | H01Q 1/241 343/820 |
| 7,079,079 | B2 * | 7/2006 | Jo | H01Q 1/243 343/700 MS |
| 8,704,727 | B2 * | 4/2014 | Cruz | H01Q 1/246 343/700 MS |
| 9,615,266 | B1 * | 4/2017 | Cheadle | H04W 16/28 |
| 10,243,412 | B1 * | 3/2019 | Fink | H02J 50/27 |

(Continued)

*Primary Examiner* — Hasan Islam

(74) *Attorney, Agent, or Firm* — Sofer & Haroun, LLP

(57) ABSTRACT

An antenna array with control circuitry placed at a front of the antenna array and between the antenna elements. By locating the azimuth beamforming network control circuitry on the front of the array and between antenna elements, the antenna elements and the other components can be coupled to the control circuitry without using cables. This leads to a reduction in the number of cable connections and to a reduction in size and weight of the resulting antenna array. The ABFN control circuitry is also used to control the beams formed from each row and not from each column as is usually done.

4 Claims, 11 Drawing Sheets

(56) References Cited

U.S. PATENT DOCUMENTS

| | | | | |
|---|---|---|---|---|
| 2001/0054983 | A1* | 12/2001 | Judd | H01Q 23/00 343/810 |
| 2007/0229385 | A1* | 10/2007 | Deng | H01Q 1/246 343/797 |
| 2008/0143601 | A1 | 6/2008 | Xu | |
| 2009/0021437 | A1* | 1/2009 | Foo | H01Q 1/246 343/761 |
| 2011/0205119 | A1* | 8/2011 | Timofeev | H01Q 1/246 342/373 |
| 2013/0181880 | A1* | 7/2013 | Shen | H01Q 1/523 343/853 |
| 2014/0347238 | A1* | 11/2014 | Beausang | H01Q 19/10 343/836 |
| 2017/0194703 | A1* | 7/2017 | Watson | H01Q 21/065 |
| 2019/0115664 | A1* | 4/2019 | Veihl | H01Q 5/385 |

* cited by examiner

ANTENNA ARRAY WITH ABFN CIRCUITRY

RELATED APPLICATIONS

This application is a non-provisional of U.S. Provisional Patent Application No. 62/579,680, filed Oct. 31, 2017.

TECHNICAL FIELD

The present invention relates to antenna arrays. More specifically, the present invention relates to systems and devices for use with antenna arrays for use in wireless communications applications.

BACKGROUND

The communications revolution of the early 21st century has given rise to the ubiquity of the smartphone handset. With this comes a much higher demand for wireless communications coverage and, accordingly, more and better antenna arrays to provide such coverage. However, one problem with current antenna array technologies is their bulk—current arrays are large, bulky, and heavy.

The wideband multibeam planar antenna array consists of the wideband element, the wideband Elevation Beam Forming Network (EBFN), the wideband Azimuth Beam Forming Network (ABFN), and related antenna input connectors and cable connections. There are two kinds of multibeam planar antenna arrays: the fixed electrical down-tilt (EDT) array and the variable EDT array. Normally, due to the use of the simple T-splitter power splitter, the EBFN board can be integrated into the feed boards of the wideband elements in the fixed EDT array. For the variable EDT array, due to the phase shifter nature of the EBFN (using either a rotary phase shifter or a sliding phase shifter), it is very difficult to integrate the EBFN board into the feed boards of wideband elements. There is therefore a need to connect the EBFN board to the feed boards by way of cables. A consequence of this is that the number of cables increases dramatically as array size increases. For example, for a 3 beam dual polarization array with 7 columns and 5 rows, there are 84 cable connections: 70 (2 EBFN boards×7 colums×5 rows) between the wideband elements and the EBFN boards, and 14 (2 ABFN boards×7 BFN boards) between the ABFN boards and the EBFN boards.

In addition to the required cable attachments noted above, for such an array, in order to realize the EDT angle for each beam independently, the location of the ABFN and the EBFN boards in the array architecture must be exchanged. In other words, the ABFN boards (i.e. the Butler matrix) is between the antenna element and the EBFN board. Due to the nature of ABFN boards, both the connection between the wideband element and ABFN board and the connection between the ABFN board and EBFN board must be done through the use of cable connections. For the example given above (a 3 beam dual polarization array with 7 columns and 5 rows) there are 100 cable connections: 70 (2 ABFN boards×7 columns×5 rows) between each element and the ABFN boards and 30 (2 ABFN boards×3 EBFN boards×5 rows) between ABFN boards and EBFN boards. Because so many cable connections need to be used, the resulting multibeam array is bulky, heavy, complex, has poor electrical performance and poor passive inter-modulation (PIM), and the array cannot even be manufactured.

There is therefore a need for systems and devices that allow for the design and manufacture of such arrays.

SUMMARY

The present invention relates to an antenna array with control circuitry placed at a front of the antenna array reflector and between the antenna elements. By locating the azimuth beamforming network control circuitry on the front of the array and between antenna elements, the antenna elements and the other components can be coupled to the control circuitry without using cables. This leads to a reduction in the number of cable connections and to a reduction in size and weight of the resulting antenna array. The ABFN control circuitry is also used to control the beams formed from each row and not from each column as is usually done.

In a first aspect, the present invention provides an antenna array comprising:

- a plurality of antenna elements positioned in a line on a front of said array reflector, said plurality of antenna elements defining a single row of said array; and
- at least one set of control circuitry for controlling at least one beam produced by said single row, each one of said at least one set of control circuitry being located on said front of said array reflector and between a pair of antenna elements, said at least one set of control circuitry being an azimuth beamforming network.

In a second aspect, the present invention provides a row of antenna array elements comprising:

- a plurality of antenna elements positioned in a line on a front of said array reflector; and
- at least one set of control circuitry for controlling at least one beam produced by said single row, each one of said at least one set of control circuitry being located on said front of said array reflector.

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1:
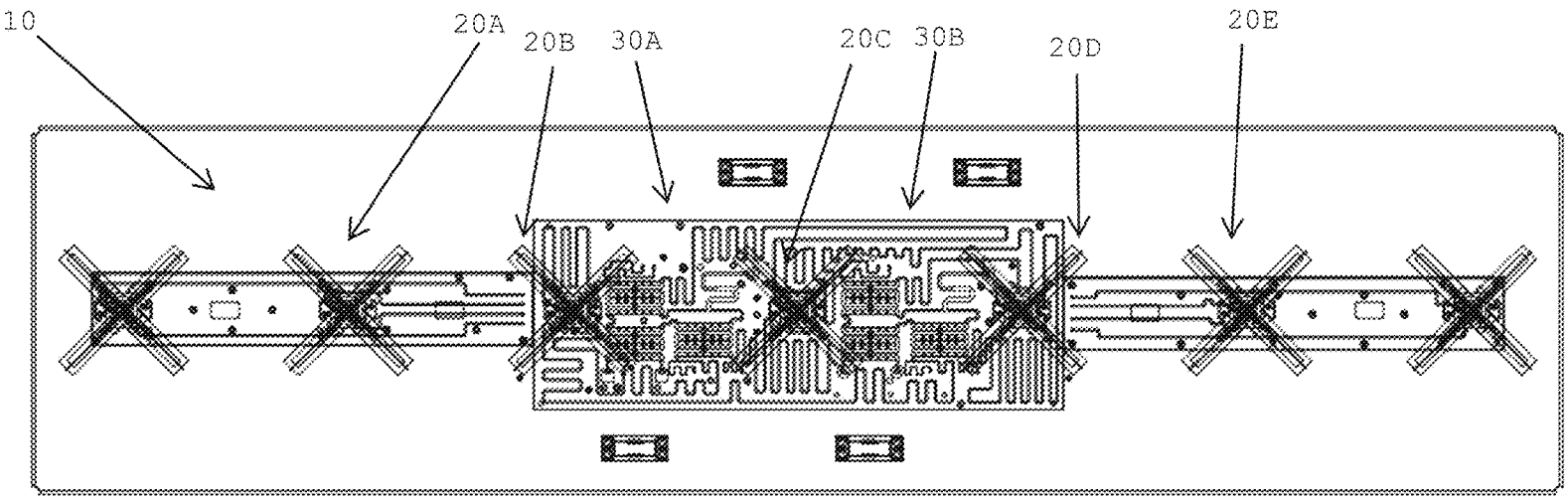
FIG. 1 is a top view of an antenna array according to one aspect of the invention.
Figure 2:
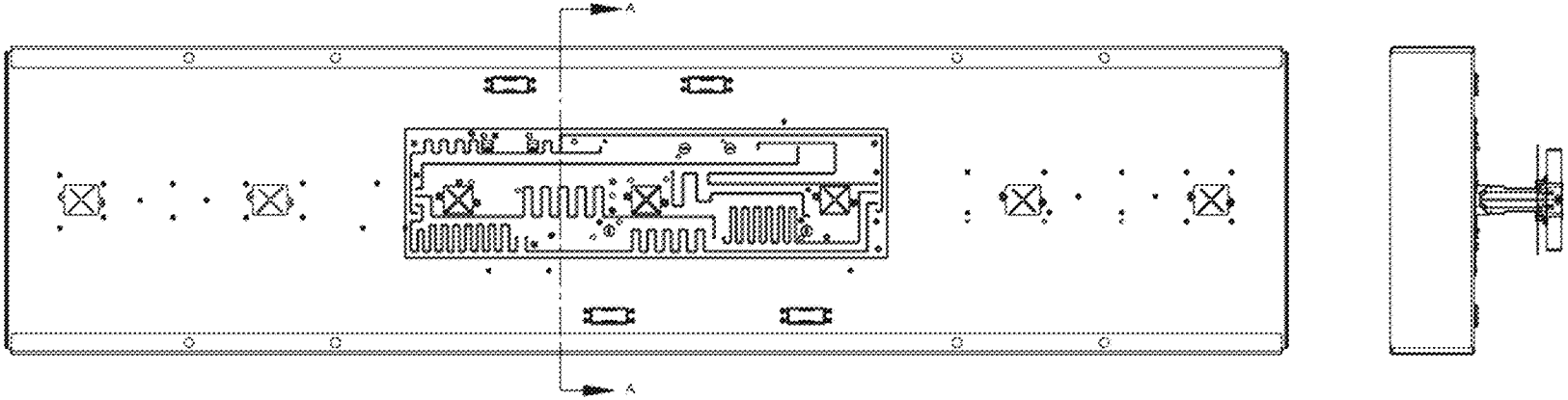
FIG. 2 illustrates a bottom view and a side view of the antenna array illustrated in FIG. 1.

Referring to FIG. 1, a top view of a single row of antenna elements according to one aspect of the invention is illustrated. FIG. 2 is a bottom view and a side view of the single row of antenna elements illustrated in FIG. 1 with the side view being taken along lines A-A in the Figure. As can be seen, the row 10 of antenna elements has a number of antenna elements 20A, 20B, 20C, 20D, 20E. Control circuit boards 30A, 30B are located at the front of the array reflector and are located between antenna elements 20B, 20C, 20D. In this implementation of one aspect of the invention, there are seven antenna elements in a single row and the beams produced by these elements are controlled by two ABFN control circuitry 30A, 30B. These control boards 30A, 30B are located between the antenna elements on the front of the array reflector. These control circuitry boards for the azimuth beamforming networks are integrated into the feed boards for the antenna elements and are configured to control the beams on a per row basis as opposed to the more conventional per column basis. For this implementation, two ABFN control circuitry boards are used to control the beams from each row of antenna elements.

Figure 3:
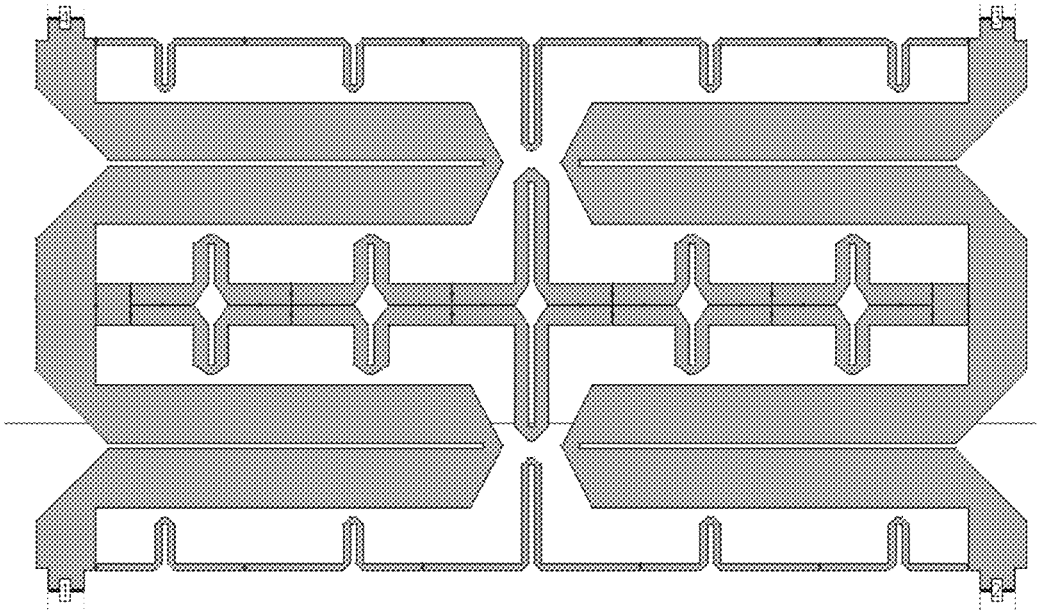
FIG. 3 illustrates a compact coupled line coupler used in one aspect of the invention.
Figure 4:
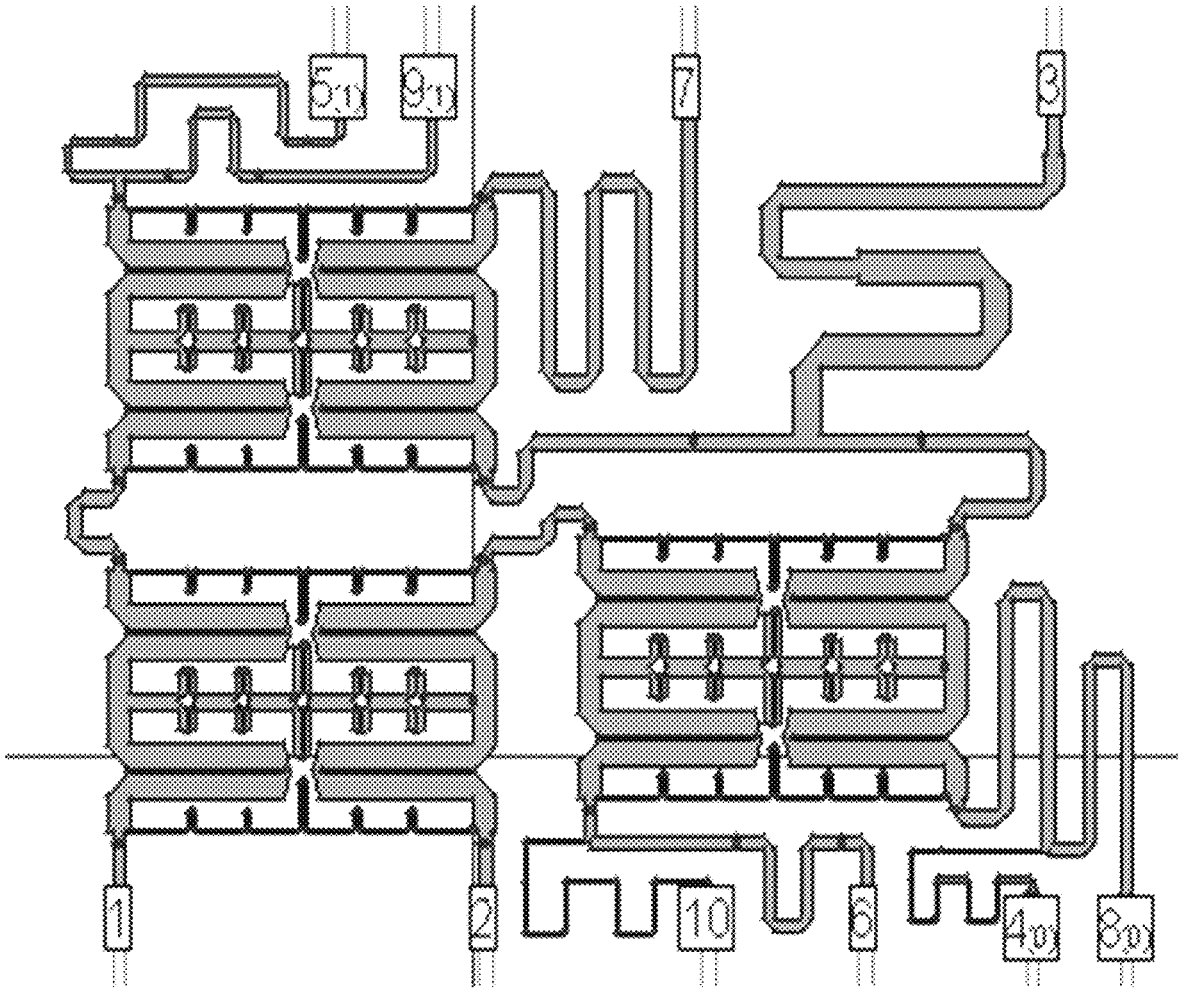
FIG. 4 shows a 3×7 ABFN circuit using the coupled line structure illustrated in FIG. 3.

It should be noted that, to integrate the beam forming network feedboards together, the sizes of the related RF parts are reduced. In order to achieve the reduction in physical size of the feedboards, a compact coupled line structure may be used in the hybrid coupler. Using such a coupled line structure in the hybrid coupler reduces the size of the coupler and the bandwidth of the hybrid coupler is improved. By using less order hybrid couplers with the coupled line structure, the same bandwidth of the couplers is maintained and the area used by the couplers is reduced dramatically. FIG. 3 illustrates the coupled line coupler. Usage of such ultra bandwidth compact hybrid couplers allows for the construction of compact ABFN (i.e. Butler matrix) circuits for the azimuth beamforming for the array. FIG. 4 illustrates a 3×7 ABFN circuit incorporating three instances of the coupled line structure shown in FIG. 3.

As can be seen from FIG. 3, the coupled line coupler illustrated have a number of unique features when compared to a branchline coupler. In the coupled line coupler of FIG. 3, the impedance transition feature of the coupled line structures (i.e. connected coupled line at one end) is introduced into the branchline coupler as the branch line. The bandwidth of the branchline coupler is thus significantly improved and the size of the resulting coupler is dramatically reduced.

For best results, the ABFN control circuitry is used at the row level. This means that the ABFN control circuitry is used to control the beams produced by each row as opposed to controlling the beams produced by each column as in the prior art. This configuration allows arrays with this structural feature to produce a three beam variable electrical down-tilt (VET). Thus, for a 5 row VET multibeam array, there are 10 ABFN boards controlling the beams produced by the 5 rows of antenna elements. This is because each row is controlled by two ABFN boards. Thus, for five rows, a total of 10 ABFN boards are used (5 rows×2 ABFN boards per row) for the 5 row array.

It should be noted that placing the ABFN boards at the front of the antenna array reflectors can significantly cut down on the cable connections between the control circuitry and the antenna elements. In one example, in the prior art, to realize a three beam array with a 10 dB cross-over point between beams, a seven antenna element array (with the seven antenna elements arranged in a row) may be used. In the prior art, the two ABFN control circuitry boards used to control the seven elements would be located at the back of the array reflector. This means that fourteen cable connections would be needed to connect each antenna elements to each of the control circuitry boards (2 control circuitry boards.times.7 antenna elements). However, by locating the ABFN control circuitry boards on the front of the array reflector, the boards can be connected to each of the antenna elements using suitably aligned pins and holes in the array reflectors.

Figure 7:
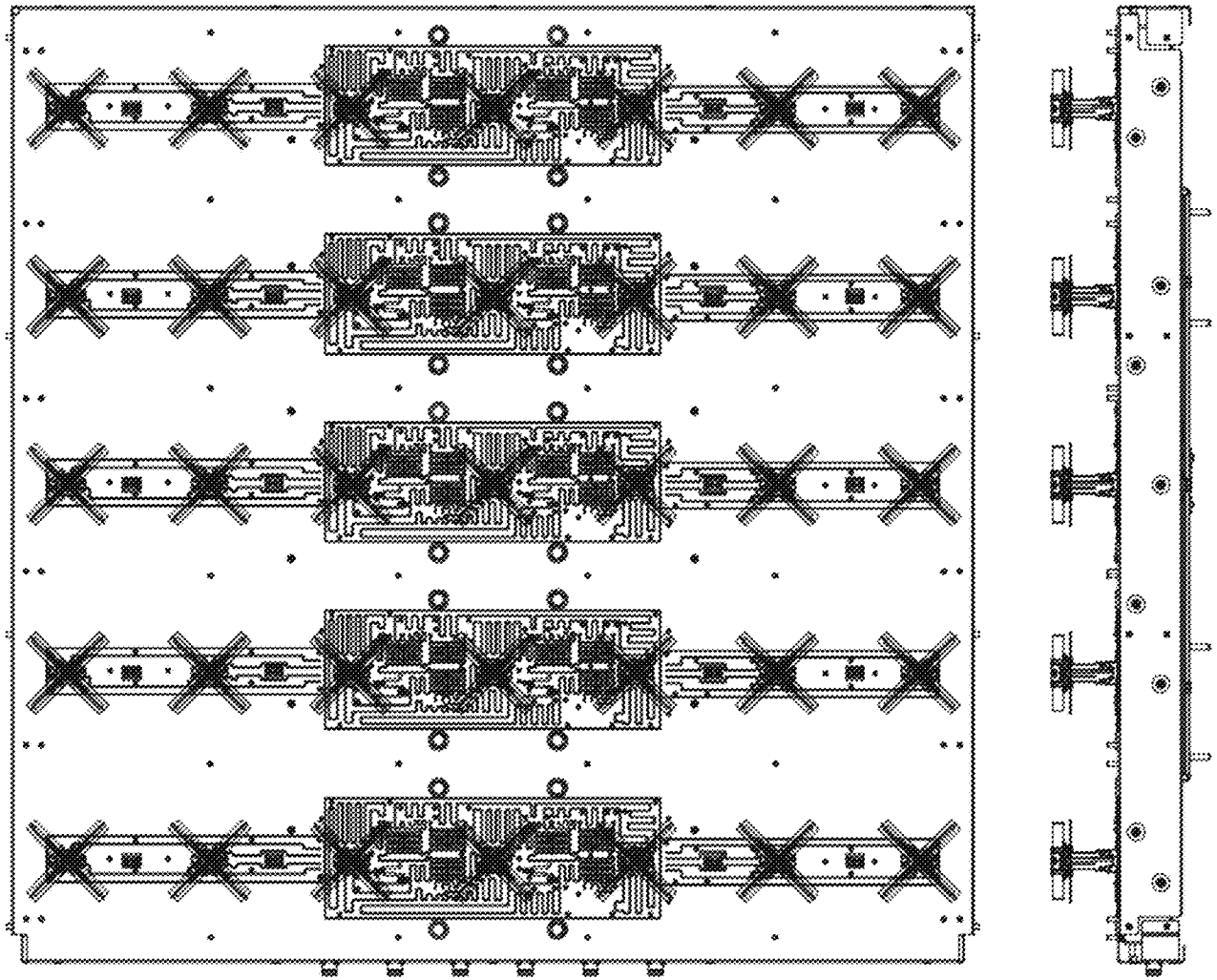
FIG. 7 illustrates top and side views of a five row, seven column antenna array incorporating at least one aspect of the present invention.

To improve the performance of the resulting array, specific configurations based on the projected use of the array may be used. As an example, based on the desired beam coverage and the desired grating lobe, the spacing between the different columns in the array may be less than half the wavelength of the operating frequency band. Such a spacing would lead to a strong mutual coupling between antenna elements and degraded cross-polarization isolation between two desired polarizations. To address this issue, fingers and fences around/between the antenna elements as shown in Fig.1 and FIG. 7, may be used. In Fig.1, some metal fences 40A, 40B, 40C, and 40D are installed for example on a front of said array reflector as shown in a rectangular shape between antenna elements 20A and 20B, 20D and 20E. Metal reflector 50 serves as structural support for the antenna elements and shapes the beam of the dipole antenna As shown in Fig.7 with black rectangular shapes, there are four metal fences 140A, 140B, 140C, 140D placed between first/second, second/third, fifth/sixth, sixth/seventh dipoles at each row. In total, there are quantity twenty (20) metal fences used in that antenna array. Such devices can reduce the mutual coupling between antenna elements to thereby improve cross-polarization isolation as well as the related pattern performances.

It is preferred that the azimuth and elevation spacings of the antenna elements be selected carefully to balance between the grating lobe at the high end of the operating frequency band and multi-coupling between the antenna elements.

Figure 5:
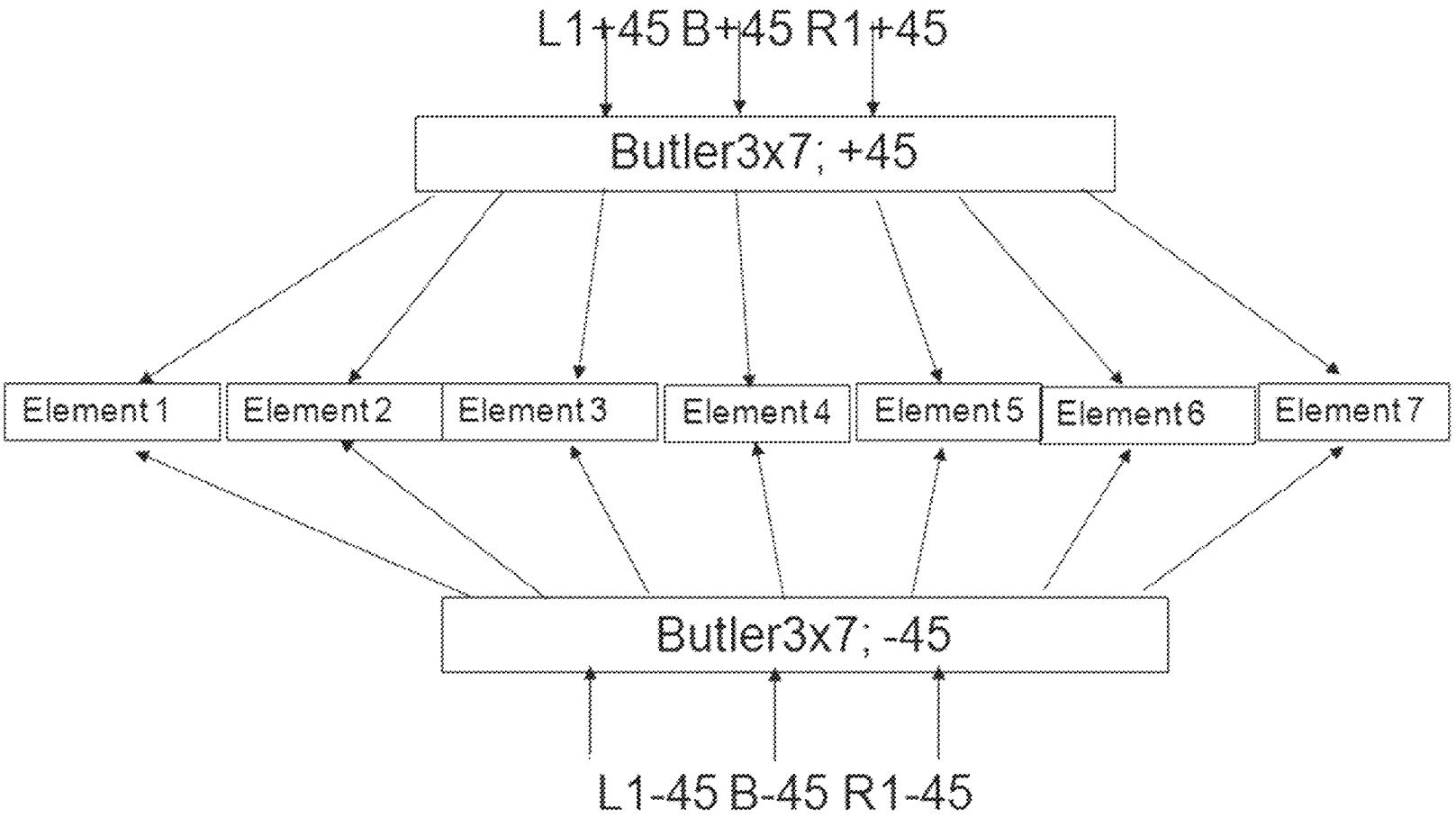
FIG. 5 illustrates a control scheme for a planar array using a single row of seven antenna elements.
Figure 6:
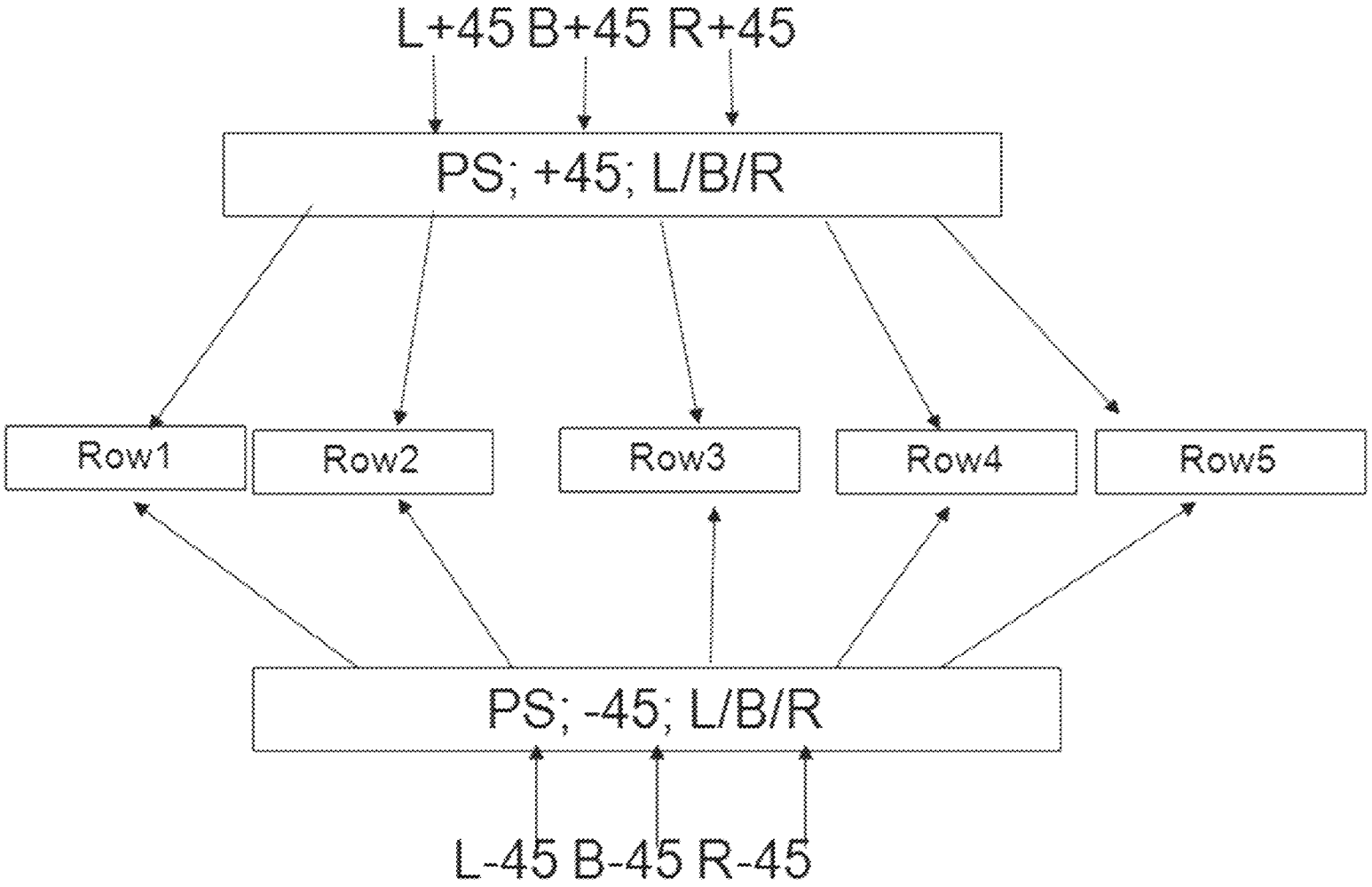
FIG. 6 shows a control scheme for a planar array using five rows and seven columns of antenna elements.

To illustrate the control schematic per row, FIG. 5 illustrates the control scheme for a planar array with a single row of seven elements. Each element in the row constitutes a column (to result in seven columns) and the row is fed by two 3×7 ABFN control boards (i.e. a Butler matrix) to realize dual polarized three beam patterns. Similarly, FIG. 6 illustrates a control scheme for a planar array with five rows and seven columns to realize dual polarized six beam patterns with 2-16 degrees of the down-tilt angle. The array in FIG. 6 is fed by ten 3×7 ABFN control boards and six phase shifters (i.e., EBFN control boards).

Figure 8:
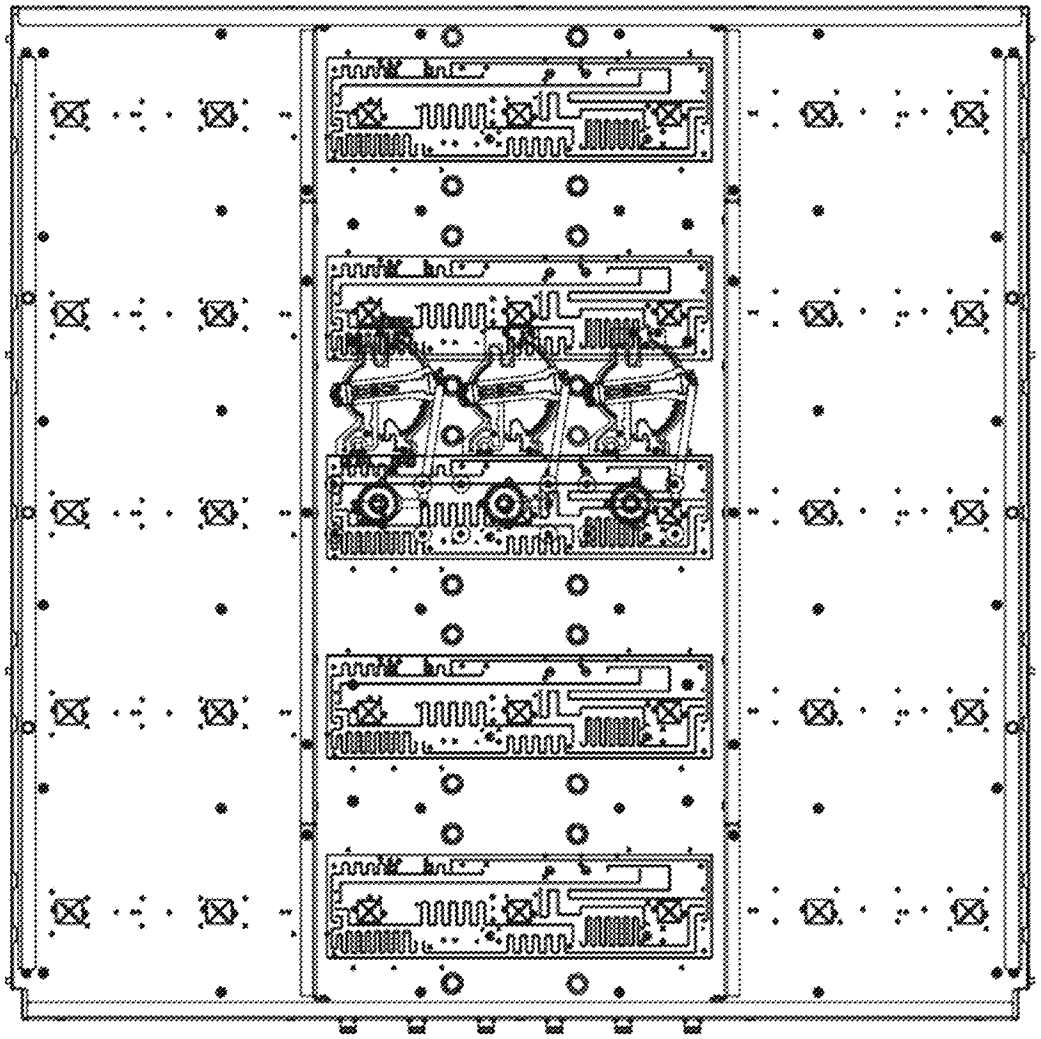
FIG. 8 illustrates a back view of the antenna array illustrated in FIG. 7.

Referring to FIG. 7, top and side views of a five row, seven column antenna array according to one aspect of the invention is illustrated. As can be seen, the ABFN control circuitry is, much like in FIG. 1, at the front of the antenna array reflector and the ABFN boards are placed in the space between the antenna elements. FIG. 8 illustrates the back or rear of the five row, seven column antenna array in FIG. 7.

Figure 9A:
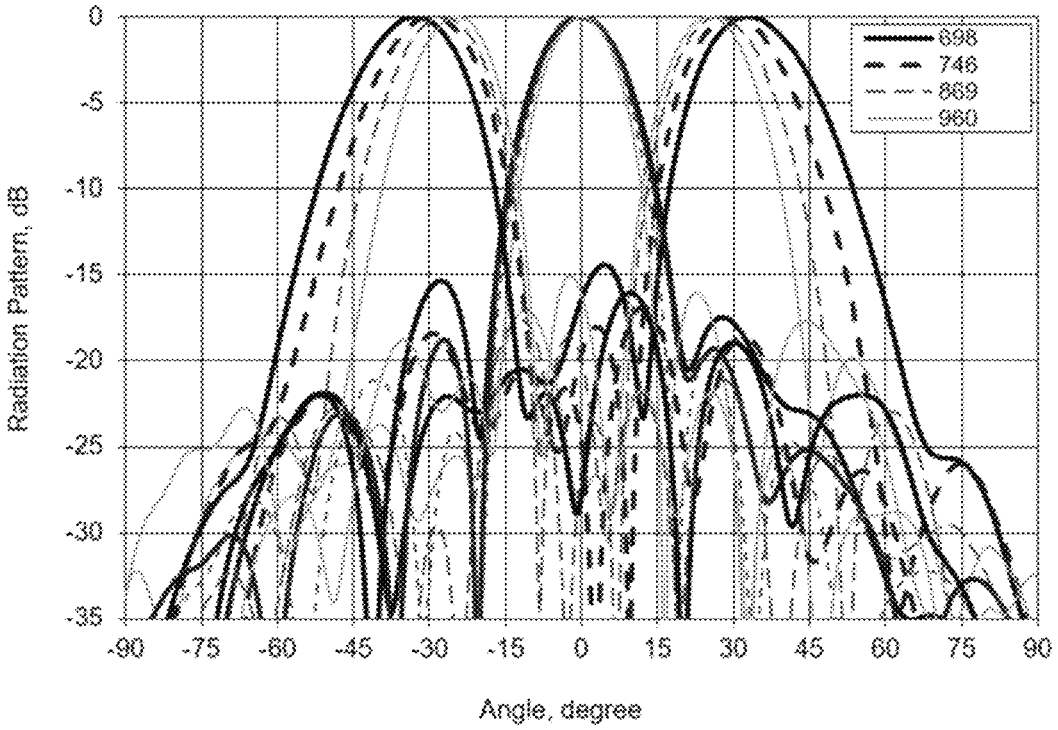
FIGS. 9A and 9B show the measured pattern results of the one row array (FIG. 1, +45 deg) with a 10 dB AZ cross-over point.
Figure 9B:
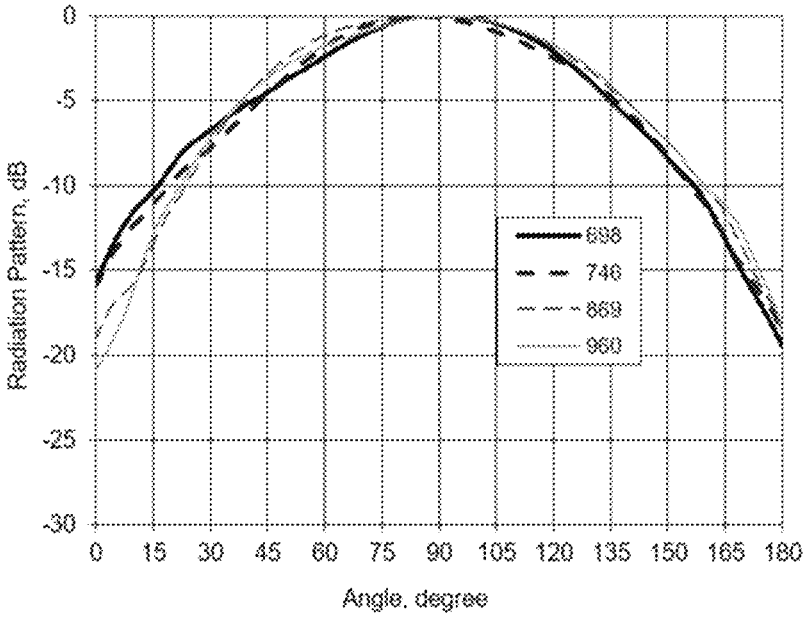
Figure 10A:
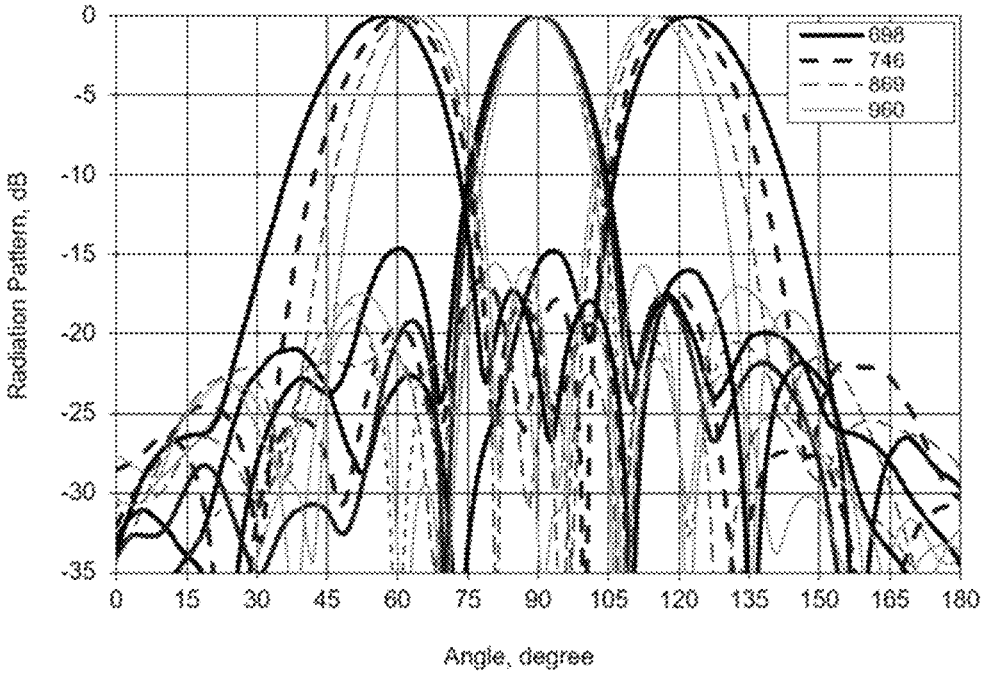
FIGS. 10A and 10B show the measured pattern results of the dual polarization five row array (FIG. 7, +45 deg) at 0 degree EDT angle.
Figure 10B:
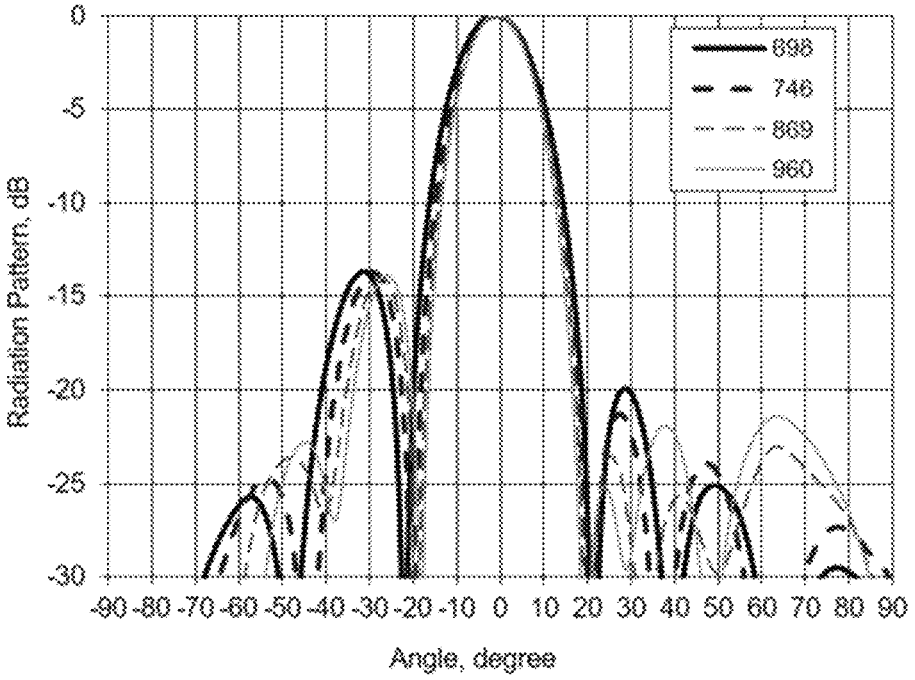
Figure 11A:
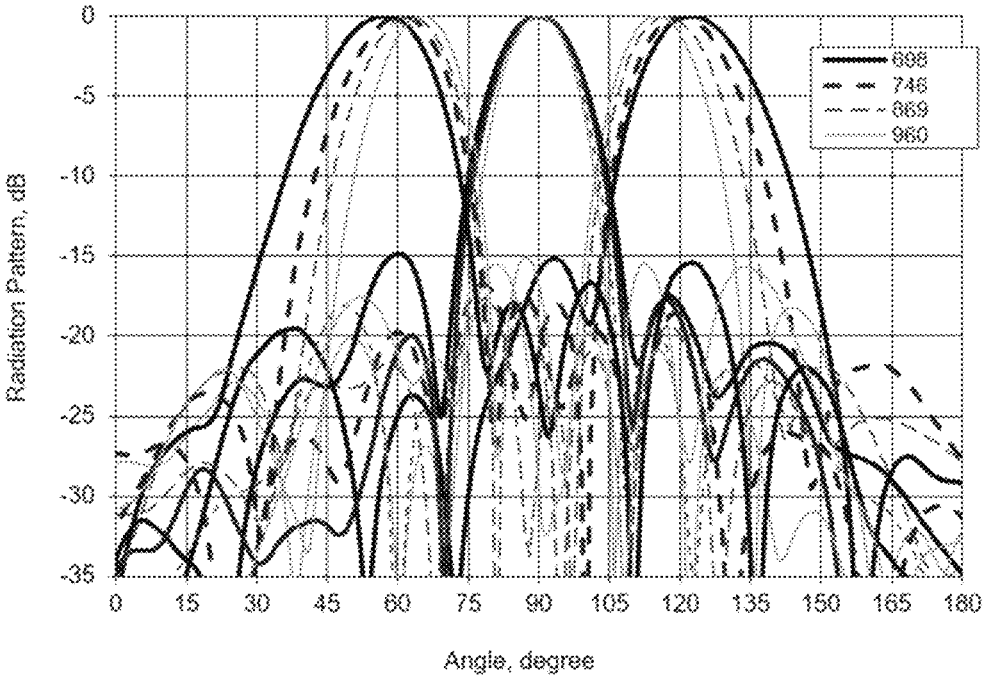
FIGS. 11A and 11B illustrate the measured pattern results of the dual polarization five row array (FIG. 7, +45 deg) at 6 degree EDT angle.
Figure 11B:
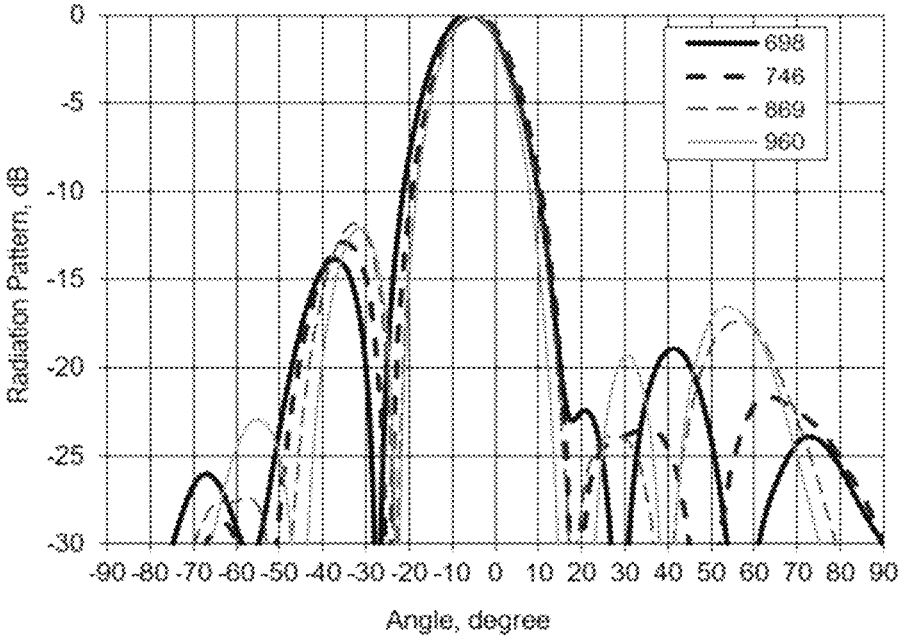
Figure 12A:
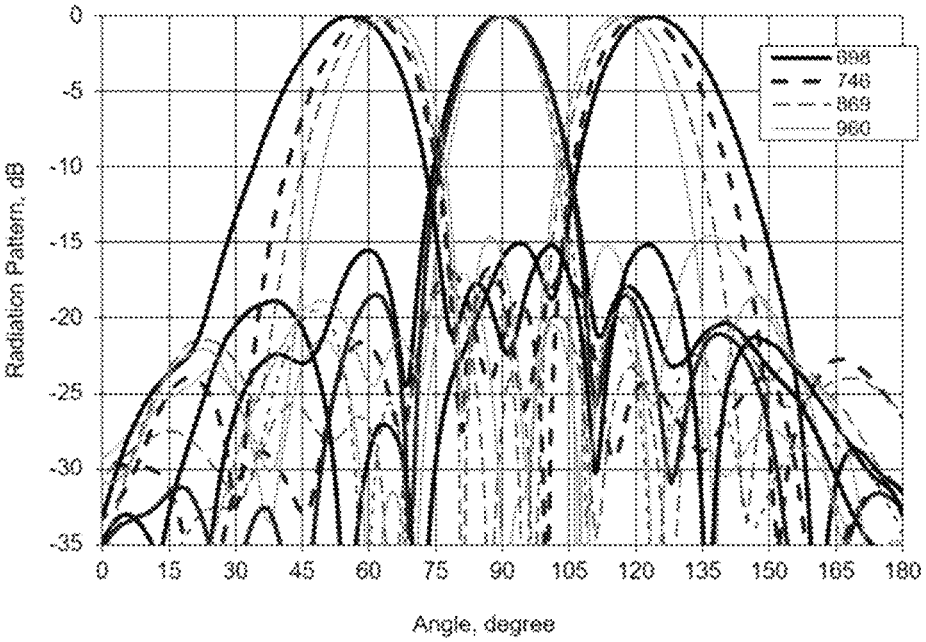
FIGS. 12A and 12B show the measured pattern results of the dual polarization five row array (FIG. 7, +45 deg) at a 14 degree EDT angle.
Figure 12B:
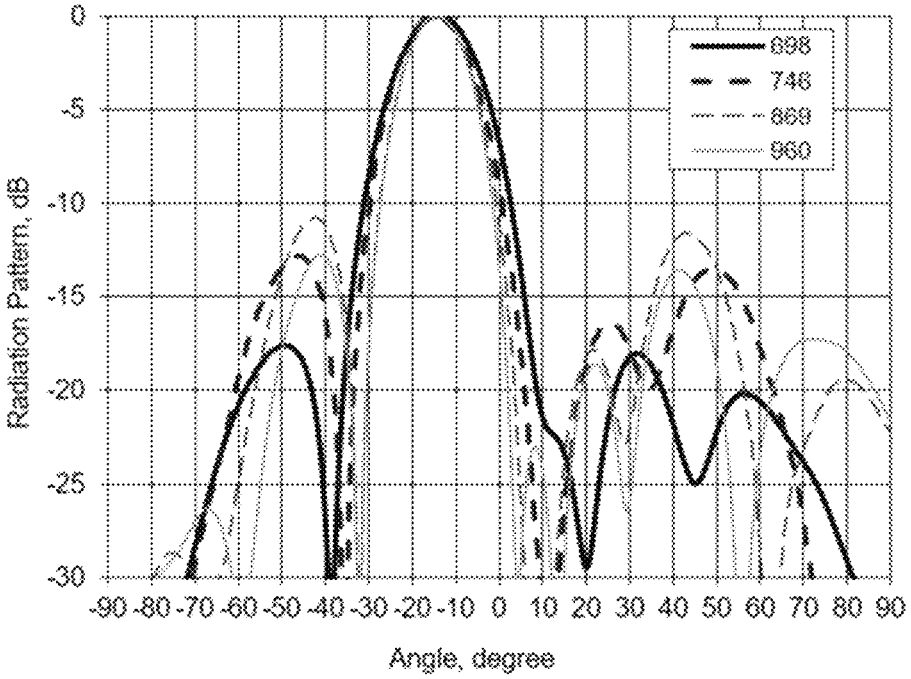

In FIGS. 9A and 9B, the measured azimuth (FIG. 9A) and elevation (FIG. 9B) pattern results of the one row array (+45 deg) are shown. For the azimuth plot, the worst sidelobe level is around 15 dB and the cross over points between beams are around 10 dB. Because only one row is involved, only zero (0) degree EDT angle can be achieved. FIG. 10A shows the measured azimuth pattern and FIG. 10B shows the elevation pattern for the dual polarization five row array at a 0 degree EDT angle. FIG. 11A shows the measured azimuth pattern and FIG. 11B shows the elevation pattern for the dual polarization, five row array at a 6 degree EDT angle. Similarly, FIG. 12A shows the measured azimuth pattern and FIG. 12B shows the elevation pattern for the dual polarization five row array at a 14 degree EDT angle. Due to the similarity with −45 degree polarization, only pattern results with +45 degree polarization ports are presented in FIGS. 9-12. From FIGS. 10, 11, and 12, it can be seen that, when the EDT angle is changed from 0 and 14 degrees through tuning the phase shifters, the azimuth patterns are well maintained.

It should be noted that variations on the embodiments of the invention are also possible. As an example, instead of using a seven column antenna array, reducing the number of columns in the array may result in a performance improvement. As an example, instead of a 10 dB cross-over point for the 3-beam antenna array which uses seven columns, experiments have shown that a 3-beam antenna array with six columns can achieve a 6 dB cross-over point. Similarly, staggering antenna elements along the elevation results in beam patterns with less elevation grating lobes (i.e. improved mutual coupling between antenna elements). As well, better elevation side lobe levels (SLL) are achieved for a multi-beam array when the antenna elements are staggered along the elevation. As an example, an 80 mm staggering distance for the 3 beam antenna array with seven columns results in a 2 dB elevation SLL improvement and a 5 dB elevation grating lobe (GL) improvement. As another variant, the ABFN and the number of columns in the array can be changed to result in the desired beam patterns for any number of input ports (i.e. using anywhere from 2-30 input ports). As an example, if 5×10 ABFN control circuit boards are used with a 10 column antenna array (to replace the 3.times.7 ABFN control circuitry boards), a 5 beam VET array can be realized as noted above.

A person understanding this invention may now conceive of alternative structures and embodiments or variations of the above all of which are intended to fall within the scope of the invention as defined in the claims that follow.

What is claimed is:

1. An antenna array comprising:

an array reflector;

seven antenna elements positioned in a line on a front side of said array reflector, said seven antenna elements defining a single row on said array reflector;

two sets of control circuitry for controlling multiple beams produced by said single row of said array reflector, a first one of said two sets of control circuitry being located on said front side and between third and fourth antenna elements of the seven antenna elements to form a first azimuth beamforming network, and a second one of said two sets of control circuitry being located on said front side and between fourth and fifth antenna elements of the seven antenna elements to form a second azimuth beamforming network, wherein said fourth antenna element is between said third antenna element and said fifth antenna element, and said fourth antenna element is at a center of said single row on said array reflector, wherein said seven antenna elements are controlled by said two sets of control circuitry with +45 degree and −45 degree polarizations, each of said two sets of control circuitry being integrated into a feeding board for the seven antenna elements via connections in said array reflector with a connection board on a back side of said antenna array reflector, wherein said two sets of control circuitry include three compact hybrid couplers with a coupled line structure;

said antenna array further comprising five different rows of antenna elements on said array reflector, each row of said five different rows being a duplicate of said single row.

2. The antenna array according to claim 1, further comprising at least one fence between adjacent antenna array elements of the five different rows.

3. An antenna array comprising:

an array reflector;

a plurality of antenna elements positioned in a line on a front side of said array reflector, said plurality of antenna elements defining a single row on said array reflector;

two control circuit boards for controlling multiple beams produced by said single row of said array reflector, a first one of said two control circuit boards being located on said front side and between third and fourth antenna elements of the plurality of antenna elements to form a first azimuth beamforming network, and a second one of said two control circuit boards being located on said front side and between fourth and fifth antenna elements of the plurality of antenna elements to form a second azimuth beamforming network, wherein said fourth antenna element is between said third antenna element and said fifth antenna element, and said fourth antenna element is at a center of said single row on said array reflector, wherein said plurality of antenna elements are controlled by said two control circuit boards with +45 degree and −45 degree polarizations, each of said two control circuit boards being integrated into a feeding board for the plurality of antenna elements via connections in said reflector array with a connection board on a back side of said antenna array reflector;

wherein said single row comprises at least five antenna elements, each of said at least five antenna elements being a radiating element in a column of said array reflector, wherein said two sets of control circuitry include three compact hybrid couplers with a coupled line structure;

said antenna array further comprising five different rows of antenna elements on said array reflector, each row of said five different rows being a duplicate of said single row.

4. The antenna array according to claim 3, further comprising at least one fence between adjacent antenna array elements of the five different rows.

* * * * *